United States Patent [19]

Anagnostis et al.

[11] 4,139,661

[45] Feb. 13, 1979

[54] DEWRINKLING AND PERMANENT CREASE REFORMING OF GARMENTS

[76] Inventors: Demetrius B. Anagnostis, 2099 SW. 67th Ave., West Miami, Fla. 33155; Wilfred N. Lariviere, 3334 Garden Ave., Miami Beach, Fla. 33139

[21] Appl. No.: 776,092

[22] Filed: Mar. 9, 1977

[51] Int. Cl.[2] ..... D06M 1/18; D06M 1/24

[52] U.S. Cl. ..... 427/401; 38/144; 427/335; 427/377; 427/390 C; 427/394; 8/142; 252/8.6

[58] Field of Search ..... 38/144; 427/390 C, 394, 427/335, 401, 377; 8/142; 252/8.6

[56] References Cited

U.S. PATENT DOCUMENTS

| | | | |
|---|---|---|---|
| 2,127,650 | 8/1938 | Muller | 427/394 |
| 2,759,851 | 8/1956 | Fluck et al. | 427/394 |
| 3,617,194 | 11/1971 | Bannister et al. | 427/390 X |
| 3,617,195 | 11/1971 | Mogse et al. | 427/390 X |
| 3,745,666 | 7/1973 | Schuierer | 427/335 X |
| 3,784,355 | 1/1974 | Fielding | 427/335 X |

*Primary Examiner*—Michael R. Lusignan
*Attorney, Agent, or Firm*—Dennison, Dennison, Meserole & Pollack

[57] ABSTRACT

A composition and process for dewrinkling garments and more particularly for the process of reforming permanent creased garments wherein an undesired crease may be removed and a new permanent crease made in the fabric.

1 Claim, No Drawings

DEWRINKLING AND PERMANENT CREASE REFORMING OF GARMENTS

This invention relates to a method of removing unwanted wrinkles and creases from fabrics and articles made therefrom such as clothing and the like. Presently many methods have been developed to impart a wrinkle resistant quality to garments and at the same time applying permanent creases at the proper positions on a garment. These garments are resin treated and subsequently cured. For example, U.S. Pat. No. 2,974,432 discloses that a fabric can be impregnated with urea formaldehyde resin before cutting and sewing a garment which is then desirably creased and pressed before curing the resin with heat in a dry atmosphere. The term "permanent press" refers to garments which have been so treated.

Permanent press garments, however, present a problem when alterations are attempted because the permanent set crease has to be reformed when the garment is altered in such a manner so as to locate the crease in another desired location. Moreover, it is difficult, if not impossible, to put a new crease in the permanent press fabric after the garment has been altered.

In permanent press trousers, the garment is cuffed at the time of manufacture before it is pressed and the resin impregnated fabric cured to permanently crease the garment. In many cases the trousers have to be altered after purchase. This of course presents problems with permanent pressed trousers because a new crease cannot easily be effected and the old crease removed.

Various methods and treatments have been devised in the prior art for replacing wrinkles and reforming permanent creased garments. U.S. Pat. No. 3,436,772 discloses a method of removing wrinkles and creases by spraying onto a fabric an aqueous mist containing water, isopropyl alcohol and a small amount of glycol which causes relaxation and release of wrinkles and creases in the fabric. However, this method has application to de-wrinkling of fabrics but not to permanent crease reforming.

Also, U.S. Pat. No. 3,765,580 discloses the treatment of garments with radiant energy in achieving a "press-like look" for all "memory-recall" or permanent press fabrics, but it does not reform the permanent crease.

Still further, in the prior art, to overcome the problem of wrinkles in garments, U.S. Pat. No. 3,600,325 discloses an aerosol spray composition comprised of isopropyl alcohol and water utilized to dewrinkle fabrics without the need for ironing or pressing. However, said patent does not teach the reforming of creases in permanent press garments, only the removal of wrinkles.

U.S. Pat. No. 3,568,343 is directed to a method for altering permanent press garments by disrupting cross-linkages in the wet state and reforming them in the dry state. More particularly, an aqueous solution of a catalytic agent, such as zinc chloride, and an organic acid, such as citric acid, acts as a catalyst in the curing or polymerization of thermosetting resins used in permanent press finishes. The aqueous solution is lightly sprayed on a selected portion of a permanent press fabric which has been resin treated and cured. A selected portion of the fabric is confined in a substantially moisture-impervious container, and the container is heated under pressure to generate steam from the moisture in the aqueous solution sprayed on said selected portion. Upon drying said selected portion under pressure, the resin is repolymerized in said selected portion.

It is therefore an object of this invention to provide a novel and simple method and means for removing wrinkles and reforming creases in permanent press garments and non-permanent press garments wherein the garment is permanently recreased at the same or different locations as desired.

It is a further object of this invention to provide a method for dewrinkling and reforming permanent creased garments and non-permanent press fabric which can be carried out with readily available materials and relatively unskilled personnel in an extremely short time.

The objects of this invention are accomplished unexpectedly by utilizing a petroleum jelly emulsified in a petroleum solvent such as Mintrex or Stoddard's solvent which is sprayed onto a garment and subsequently lightly ironed. This novel result is accomplished without catalyst, the addition of resins, and the use of pressurized containers in the prior art.

EXAMPLE 1

One embodiment of the invention employs "Mintrex", manufactured by Amsco as a petroleum solvent, and Vaseline brand petroleum jelly. A 10% by weight of petroleum jelly is emulsified in 85% by weight petroleum solvent and 5% by weight deodorant if desired. This solution is poured into a spray bottle and applied lightly to the wrinkles or crease in the garment. Steam is applied as with a steam iron with little if any pressure to the sprayed area. It removes wrinkles and the permanent crease. If a new permanent crease is desired, the garment is creased appropriately and pressed with the iron to effect a permanent crease thereon which does not wash out. This treatment has been found to be effective on silks, wools, natural and synthetic fabric. The fabric dewrinkler and crease reformer of this example was used on various fabrics and garments. For instance, wrinkles were quickly and effectively removed from wool suitcoats, cotton ties, dacron-polyester fabrics and the like. In all instances, the dewrinkler and crease reformer treatment quickly and effectively removed the wrinkles and creases and the composition was quick drying and non-staining.

While the invention has been described in connection with a single embodiment thereof, it will be understood that it is capable of further modification, and this application is intended to cover any variations, uses, or adaptations of the invention following in general the principles of the invention and including such departures from the present disclosure as come within known or customary practice in the art to which the invention pertains and as may be applied to the essential features hereinbefore set forth, and as fall within the scope of the invention and the limits of the appended claims.

What is claimed is:

1. A method of removing wrinkles and repositioning permanent creases in permanent press fabrics which comprises the essential sequential steps of:

(a) impregnating the wrinkled and permanently creased portion of the fabric with a composition consisting essentially on the basis of weight of:
Stoddard solvent: 85%
petroleum jelly: 10%
deodorant: 5%

(b) subjecting the moistened fabric to steam without pressing the fabric thereby removing the wrinkles and permanent creases; and (c) repositioning the permanent creases by appropriately folding the fabric to establish appropriate crease lines and subjecting the so established crease lines to ironing to effect repositioning of the permanent creases.

* * * * *